United States Patent [19]

Daley

[11] Patent Number: 4,765,618

[45] Date of Patent: Aug. 23, 1988

[54] TABLE TENNIS ROBOT

[76] Inventor: Westphal Daley, 68 Simpson St., Hartford, Conn. 06112

[21] Appl. No.: 75,630

[22] Filed: Jul. 20, 1987

[51] Int. Cl.[4] ..... A63B 29/00

[52] U.S. Cl. ..... 273/30; 124/51 A; 124/78; 124/81; 124/1

[58] Field of Search ..... 124/51 R, 50, 78, 81, 124/82, 6, 34; 273/30, 26 R

[56] References Cited

U.S. PATENT DOCUMENTS

| | | | |
|---|---|---|---|
| 3,777,732 | 12/1973 | Holloway et al. | 124/51 R |
| 3,794,011 | 2/1974 | Newgardener, Jr. | 124/51 R |
| 3,913,552 | 6/1974 | Cook | 124/51 R |
| 4,086,903 | 5/1987 | Scott | 124/78 |
| 4,116,436 | 9/1978 | Berliner | 273/30 |
| 4,197,827 | 8/1980 | Smith | 124/78 |
| 4,299,383 | 11/1981 | Yuasa | 273/29 A |
| 4,325,351 | 4/1982 | Yuasa | 124/78 |
| 4,352,348 | 10/1982 | Griffith | 124/78 |
| 4,559,918 | 12/1985 | Bellerin | 124/78 |

*Primary Examiner*—Richard C. Pinkham

*Assistant Examiner*—T. Brown

*Attorney, Agent, or Firm*—Peter R. Bahn

[57] ABSTRACT

A table tennis robot with right and left servers, oscillatory motion, top spin and bottom spin, right and left side spin, combination of spins, or no-spin modes, variable ball speeds, and continuous recycling of balls, to provide a human player with challenging practice serves.

A ball catching net is located at one end of the tennis table. Balls caught by the net fall into a pan located below the table and are then fed upward by suction of a fan into a chamber. The chamber distributes balls one at a time into a vertical tube. At its bottom, the tube has right and left branches. A ball deflecting vane is adjustable to selectively direct a ball into either the right or left branch. The branches lead, respectively, to a right server and a left server. Each server has a rotating ball drive wheel. The output port of the right server has adjustable guide rails to impart high top spin to a ball. The output port of the left server has adjustable guide plates to impart various types of spin to a ball. The robot is oscillated about a vertical axis by a drive motor.

8 Claims, 7 Drawing Sheets

TABLE TENNIS ROBOT

BACKGROUND OF THE INVENTION

A robot can be defined as an automatic device that performs functions ordinarily ascribed to human beings. The invention to be described here is a table tennis robot that automatically serves table tennis balls to a human table tennis player. Table tennis balls that the human player hits back toward the robot are collected and continuously recycled through the robot to be served toward the human player over and over again.

Prior art table tennis machines include those described in U.S. Pat. No. 3,794,011 by Newgarden, U.S. Pat. No. 3,847,132 by Schatz, U.S. Pat. No. 3,878,827 also by Newgarden, and U.S. Pat. No. 4,077,386 by Berliner.

DESCRIPTION OF THE INVENTION

The table tennis robot is shown in detail in FIGS. 1 through 10.

Figure 1:
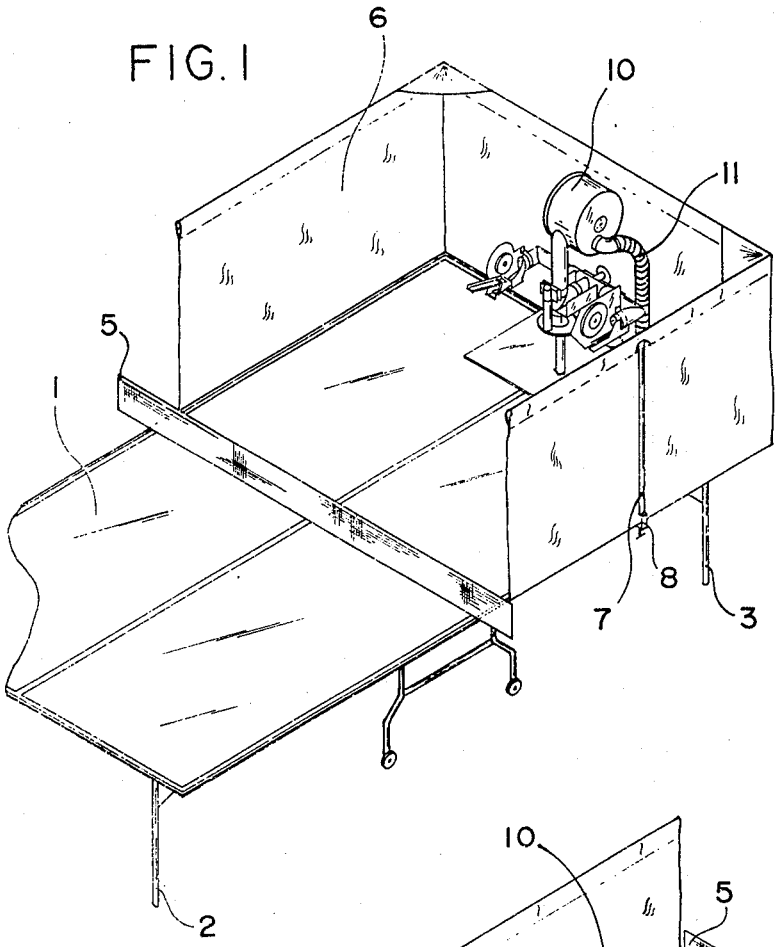
FIG. 1 shows a front-facing elevated isometric view of the robot in place on a table.

Referring particularly to FIG. 1, the table tennis robot 10 is shown sitting on the game table 1 which table is supported by the table legs 2 and 3. The net 5 is shown arranged across the game table. The human player hits balls into a catch system 6 which is made of cloth. The catch system is held in position by two rods 7 and two clamps 8 (only one shown of each).

Figure 2:
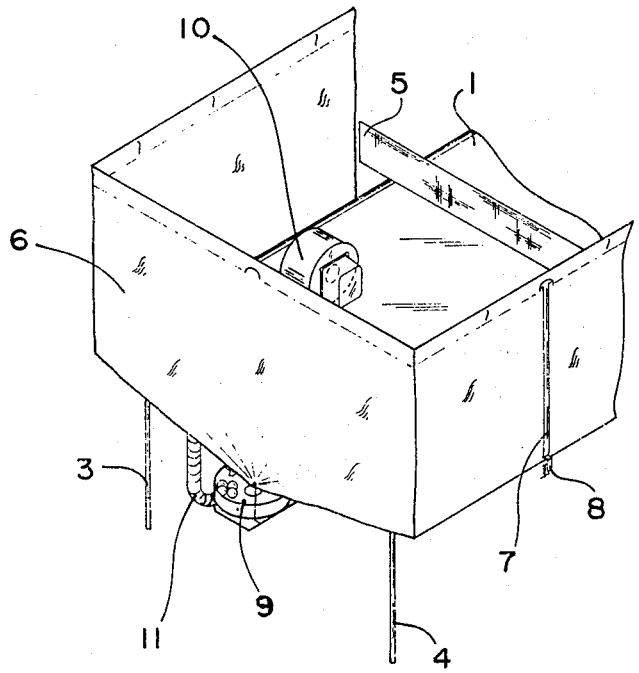
FIG. 2 shows a back-facing elevated isometric view of the robot in place on a table.

FIG. 2 shows another view of the robot 10 in place on the table 1 resting on table legs 3 and 4. The ball collecting apparatus 9 is shown below the catch system 6. A flexible hose 11 is shown running from the collecting apparatus 9 to the robot 10.

When table tennis balls are hit into the catch system 6, they fall into the bottom of the catch system 6, and then through a hole in said bottom just above the ball collecting apparatus 9.

Figure 3:
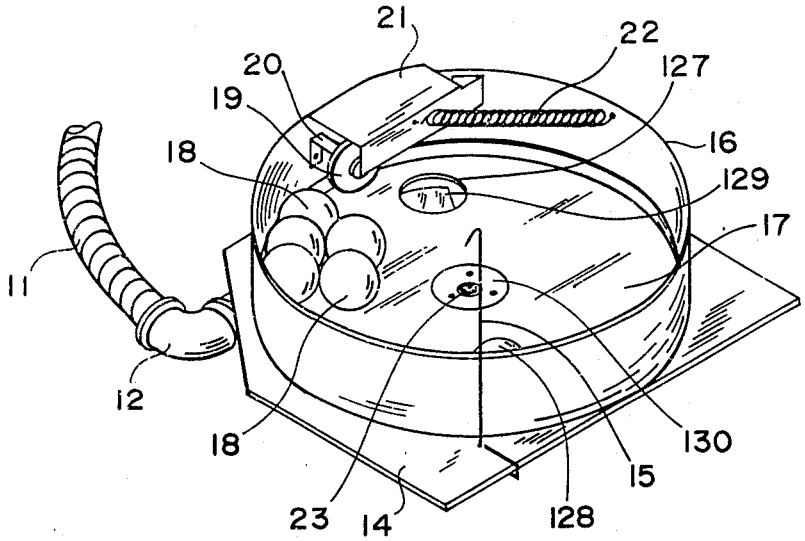
FIG. 3 shows a top perspective view of the ball collecting apparatus for the robot.

FIG. 3 shows a top view of the ball collecting apparatus. The apparatus is made of a plate 14 to which is attached a pan rim 16. Inside the pan rim is a rotating platter 17 turning about an axle 23.

The platter 17 has two holes, one hole at location 127, and the other hole 180° opposite at location 128. Balls 18 that have fallen into the platter are jostled by rotation of the platter until they fall into the holes in the platter.

When one of the balls in the platter is translocated to the position shown in FIG. 3 at 127, 129, the ball falls into a recycling input port 129 and then to elbow 12 which is connected to flexible hose 11 leading to the robot.

As the balls are carried around by the platter, the spring 22 provides a non-rigid surface for contacting the balls that are near the exit point, thus helping to prevent breakage of the balls. Wheel 19 functions as an absolute stop point for the balls and will be turned by a ball in a platter hole, thus facilitating transfer from the platter to the input port of recycling hose 11. The plate 21 covers the coincident holes so balls falling into the catchment do not fall directly into the holes.

Figure 4:
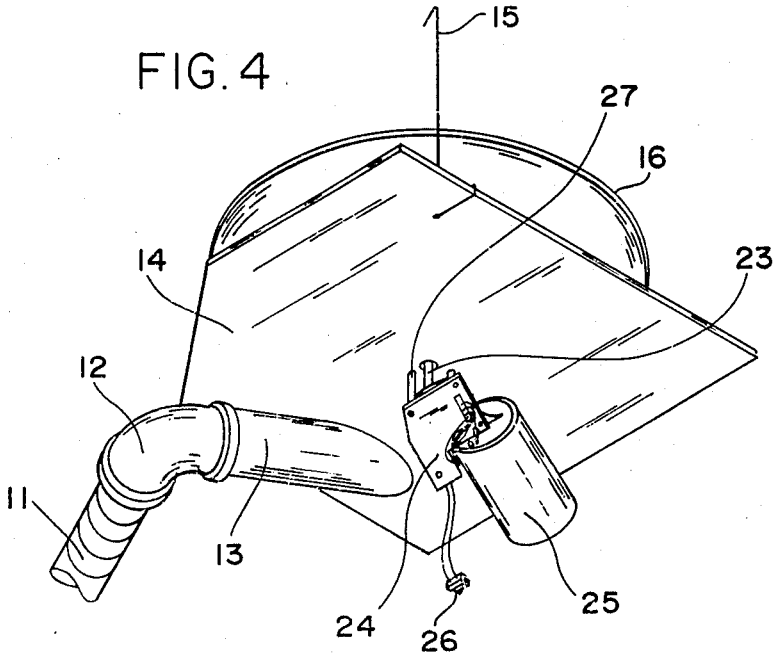
FIG. 4 shows a bottom perspective view of the ball collecting apparatus for the robot.

The recycling input port itself, 13, is shown in FIG. 4. FIG. 4 also shows the electric motor 25 that turns the platter referred to previously. The horizontal motor 25 provides rotation of the platter 17 in a horizontal plane through the gear box 24. The plug 26 goes to the motor control. There is also shown a hook rod 15 for hanging the ball collecting apparatus just below the bottom of catch system 6.

Figure 5:
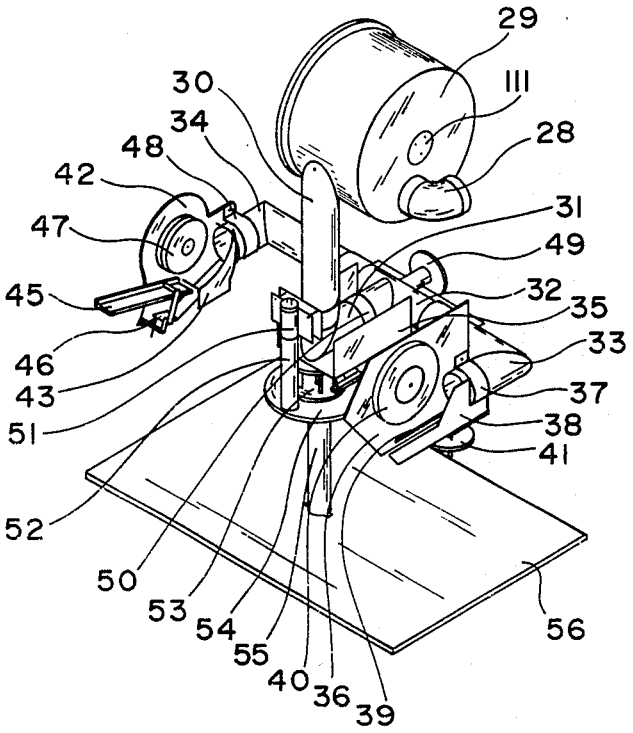
FIG. 5 shows a right side perspective view of the table tennis robot.

FIG. 5 shows a right side elevated perspective view of the table tennis robot in greater detail than is shown in Figs. 1 and 2. Starting at the top of FIG. 5, we see that the robot has a cylindrical chamber 29. Table tennis balls enter the robot via an entrance port 28 from the previously referred-to flexible hose. Inside the chamber 29, there is an electric motor 111 and a cylindrical fan. The fan imparts a motion to the balls which circulate around the inside perimeter of the chamber 29 to an exit port and down into pipe segment 30. The balls are directed through a 90° turn into a horizontal pipe segment 31, and then to a T-shaped joint 32.

At the vertex of the T-shaped joint 32 is a bias mechanism 49 for introducing a bias for balls to go either into the right serving arm or the left serving arm respectively of the robot.

Assuming a ball has been biased to head into the right server, it will leave the T-joint 32, go into a short horizontal pipe section, through a horizontal 90° turn, and then into the right server pipe section 33.

The right server is made of a plate 36 clamped to the pipe section 33 by a clamp 37. The plate 36 supports a motorized rubber-rimmed wheel 54. A guide path for balls leaving the pipe 33 is formed by the motor plate 36, a smaller plate 38, and two bottom guide rails 39 (only one visible in FIG. 5). A wheel 41 is turned to adjust the position of the guide rails 39.

Assuming a ball has been biased to head into the left server, it will leave the T-joint 32, go into a short horizontal pipe section, through a horizontal 90° turn, and then into pipe section 34.

The left server is made of a plate 42 clamped to a pipe section 34 by clamp 48. The plate 42 supports a motorized rubber-rimmed wheel 47. A guide path for balls leaving the pipe 34 is formed by the motor plate 42, a smaller plate 43, a bottom deflector 46 and a top deflector 45. A machine bolt (not shown in FIG. 5) is turned to adjust the position of the deflector plates 45 and 46.

The top half of the robot is supported by being clamped by clamp 50 to a plate 35. Plate 35 is connected to a mechanism 53 for providing oscillatory motion of the top half of the robot about an axis through support post 55 and relative to a stationary round plate 54 which is connected to support post 55. The support post 55 is itself rigidly connected to a robot base plate 56.

Figure 6:
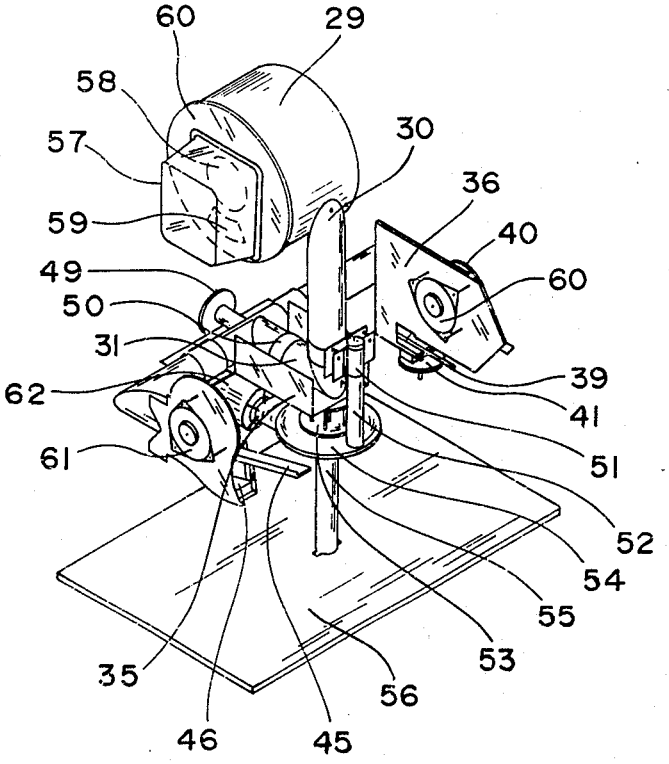
FIG. 6 shows a left side perspective view of the robot.

FIG. 6 shows a left side view of the table tennis robot. Many of the details in this view have already been explained in connection with FIG. 5. However, some of the new features revealed in this view are as follows.

The chamber 29 has a lid 60 perforated by two holes 58 and 59. The holes are covered by a pan 57 which is used to couple the vacuum of the fan to the entrance port 74 (to be shown in FIG. 7).

The electric motors 60 and 61 for the right and left servers, respectively, are also shown. FIG. 6 also shows the electric motor 62 for producing the oscillatory motion of the robot.

Figure 7:
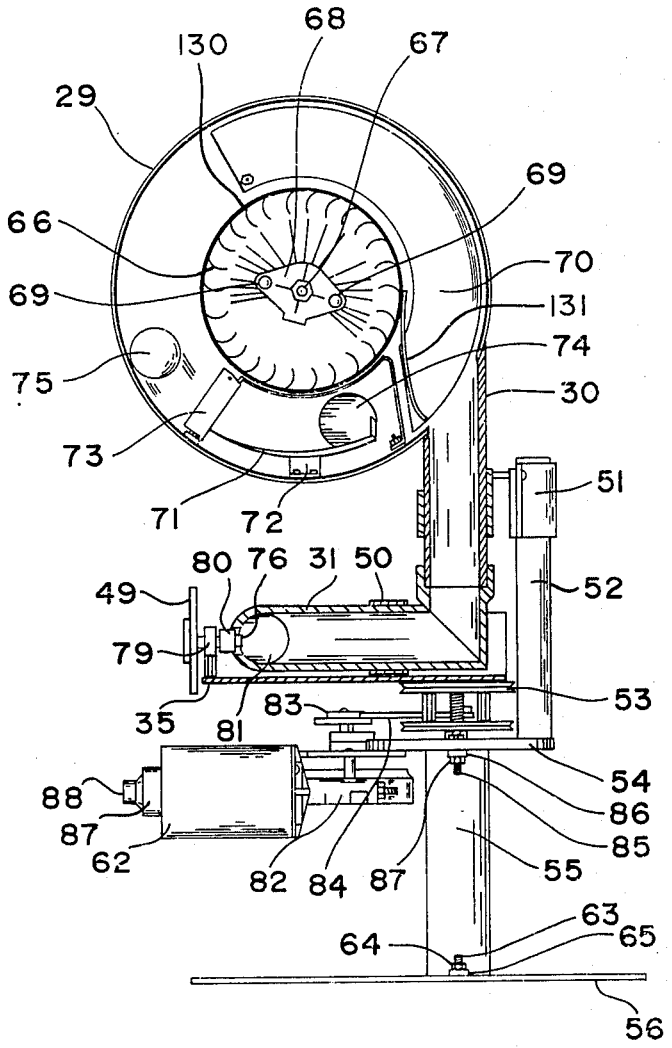
FIG. 7 shows a cross section view of the table tennis robot.

FIG. 7 shows a cross section view of the table tennis robot which will help explain the movement of table tennis balls within the machine.

Balls are fed into the chamber 29 through an entrance port 74 which leads to a curved ball guide 71 maintained in position by supports 72 and 73. A ball 75 leaving the curved guide will travel around the inner circumference of the chamber 29 until such ball gets to the chamber exit port and into pipe section 30.

The force to make balls move in the above circular path is supplied by the cylindrical fan 66 which turns about the axle 67, causing a clockwise air flow. As a ball leaves part 74 and enters container 29 it touches a rubber ring 130 around the edge of the fan, and this contact imparts an initial velocity to the ball. The ball is carried further around the circular path of container 29 by the clockwise air flow of the fan. A ball is prevented from traveling around the fan chamber a second time by a partition 131 inside the chamber. Such partition also directs an air flow into a pipe 30 and thence eventually into the servers.

After entering pipe 30, the balls move downward, make a 90° turn, and travel through pipe 31 to a bias deflector vane 76 which adds to the probability that a ball will go preferentially into the right arm or left arm of the robot depending on the rotational angle of deflector 76, the said angle being determined by the extent to which wheel 49 is turned clockwise or counterclockwise. The deflector 76 is supported by axle braces 79 and 80.

The upper half of the table tennis robot sits on a plate 35 and is held there by clamp 50. The plate 35 is in turn connected to a wheel plate 53. Wheel plate 53 is made to turn in an oscillatory fashion about the axis of a bolt 85 by a connecting rod 84 that is connected through an eccentric 83 to a gear box 82 and then to an electric motor 62. The robot is supported by post 55 which is rigidly bolted to robot base plate 56.

Figure 8:
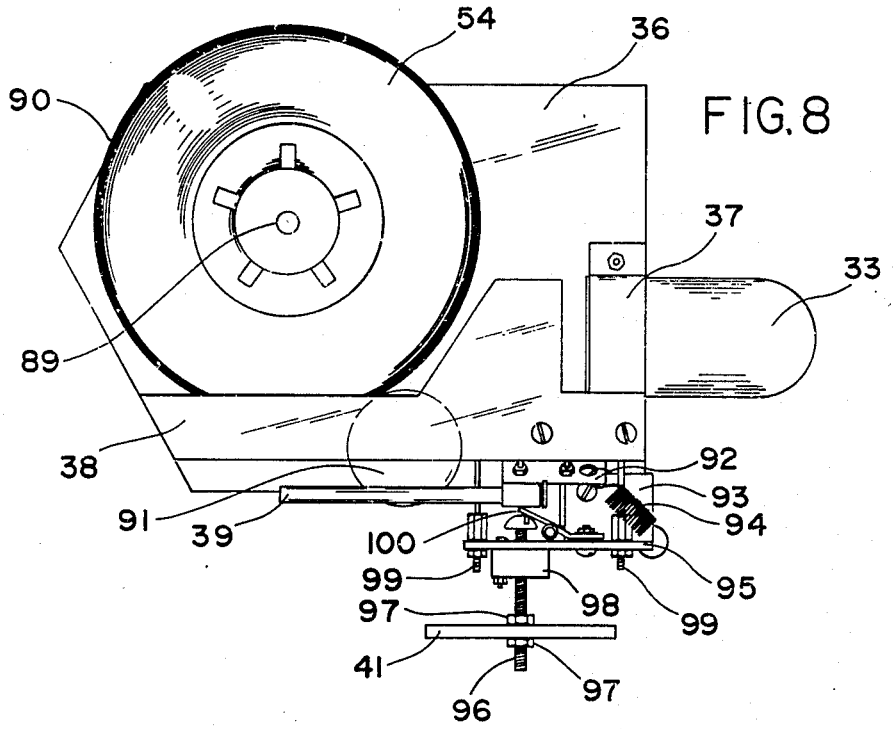
FIG. 8 shows a side view of the right server of the robot.

The right server of the table tennis robot is shown in FIG. 8. Balls are fed into the right server through input pipe 33. A ball 91 exiting pipe 33 falls into a guide path bounded on top by the rubber rim 90 of the motorized wheel 54, bounded on the sides by motor plate 36 and guide plate 38, and bounded on the bottom by guide rails 39 (only one is visible in FIG. 8).

The guide rails 39 are connected to the leaves of a hinge 92. The leaves of hinge 92 are activated by the upward movement of one leaf of another hinge 100. Hinge 100 has its other leaf bolted to a plate 95 which is connected to motor plate 36 via a tab 93 and stand-off bolts 99. A spring 94 biases the leaves of the hinge 92 in a downward direction. The machine screw 96, however, can be used to spread the leaves of hinge 92 by hand turning of the adjustment wheel 41. Such adjustment causes a repositioning of guide rails 39 in an upward spreading fashion. The rotation of the motorized wheel 54 in clockwise direction about its axle 89 imparts top spin to a table tennis ball 91 leaving the right server in addition to imparting a forward component of motion towards the left in FIG. 8.

The right server is designed to produce extremely high ball rotation (high angular velocity) which is usually only encountered when a player is executing very spinny top spins. Hence this server is basically dedicated to serving top spins and slight variations of it in terms of side spins. However, this server can be rotated if need be about the axis of pipe 33.

Figure 9:
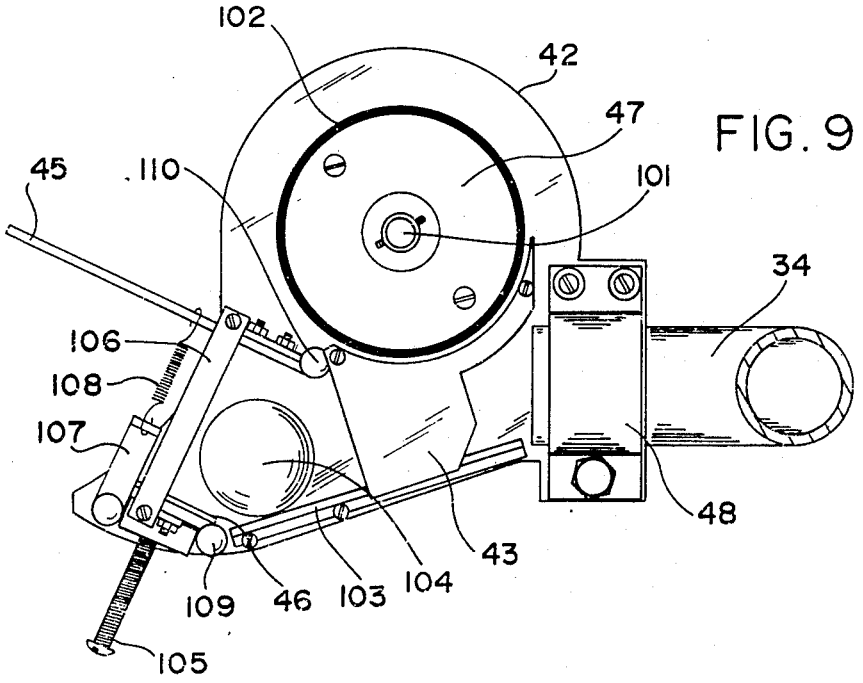
FIG. 9 shows a side view of the left server of the robot.

The left server of the table tennis robot is shown in Fig. 9. Balls are fed into the left server through input pipe 34. A ball 104 exiting through pipe 34 falls into a guide path bounded on the top by the rubber rim 102 of the motorized wheel 47, bounded on the sides by the motor plate 42 and the guide plate 43, bounded on the bottom by a plate 103, and bounded at the end of the path by a pair of deflector plates 45 and 46.

The upper deflection plate 45 and the lower deflection plate 46 are linked by an arm 106 and through hinges 109 and 110, to always be in parallel orientation relative to each other. The angle of the plates 45 and 46 relative to the ball path can be varied, however, by manual turning of an adjustment screw 105. Normally, the deflector plates 45 and 46 are biased in a downward direction by spring 108. The rotation of the motorized wheel 47 in a clockwise direction about its axle 101 imparts spin to a table tennis ball 104 leaving the left server in addition to imparting a forward component of motion towards the left in FIG. 9. The left server, however, may be rotated 360° around the axis formed by pipe 34 so that any spin can be achieved. As the plates 45 and 46 are adjusted by screw 105, the intensity of the spin on the ball changes from zero spin at a specific angle upward, to maximum spin at the lowest position of the plates.

Figure 10:
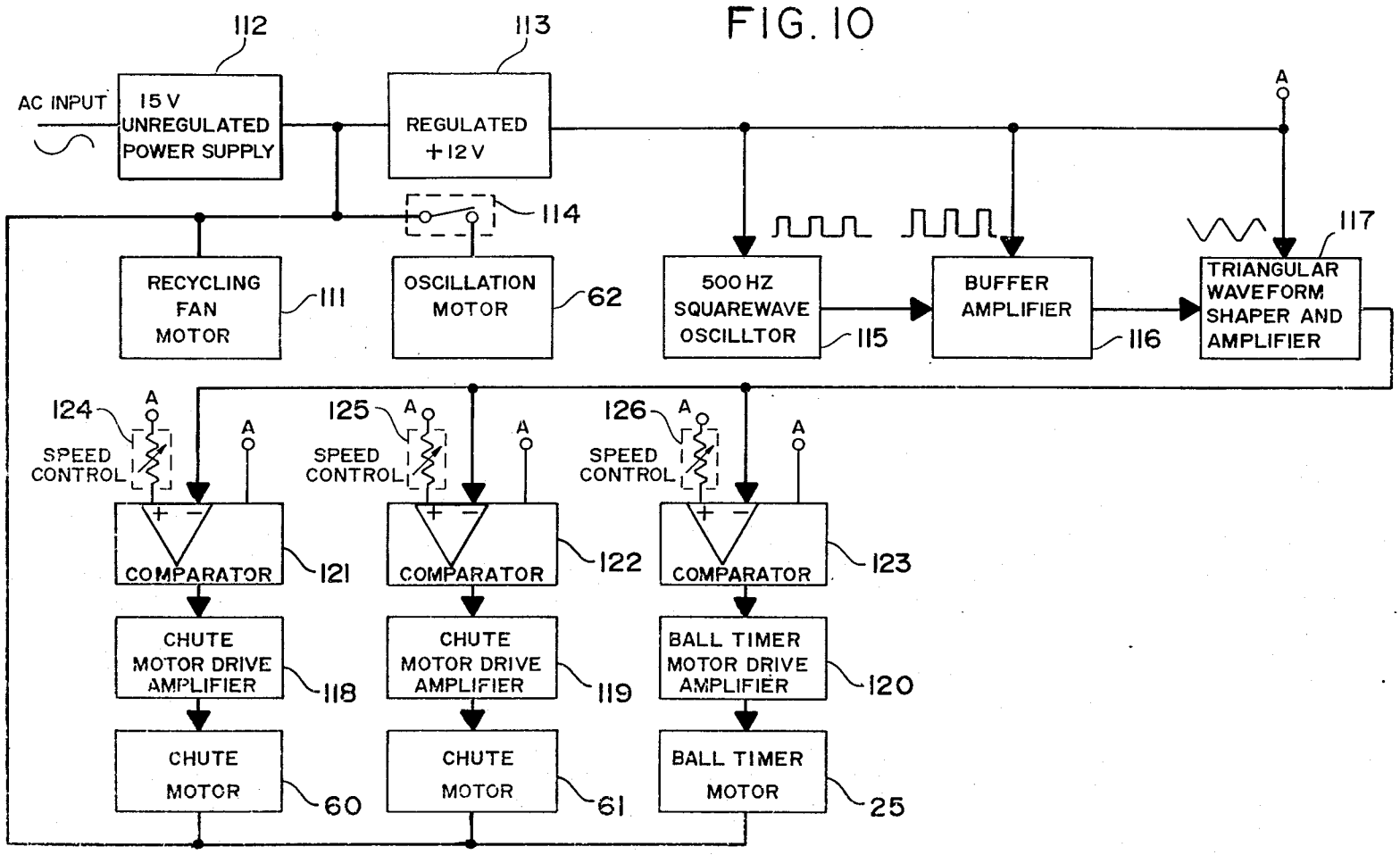
FIG. 10 shows a block diagram of the electrical and electronic components of the table tennis robot.

In FIG. 10 is shown a block diagram of the electrical and electronic components of the table tennis robot. These components are housed in a control box which is placed near the human player end of the game table for convenient access. The parts are as follows. The AC line input is connected with a 15 volt unregulated power supply 112 and also a regulated 12 volt power supply 113. The electrical power is tapped by the recycling fan motor 111, the oscillation motor 62, the ball timer motor 25, and the two chute motors 60 and 61. The recycling fan motor always operates at a constant speed. The oscillation motor also operates at a constant speed but it can be turned on or off with switch 114 (the dotted lines around switches in FIG. 10 indicates the presence of such switches on the surface of the control panel of the electrical control box of the robot).

The ball timer motor 25 and the two chute motors 60 and 61 can be given variable speeds by the speed controls 126, 125, and 124 respectively. The three motor drive amplifiers 118, 119, and 120, and the three comparators 121, 122, and 123, are standard electrical components to maintain the constancy of those particular speeds chosen for the three motors 60, 61, and 25.

The clocking standard for the three comparators 121, 122, and 123, are provided by a 500 Hertz squarewave oscillator 115, the signal of which is sent through a buffer-amplifier 116, then to a triangular waveform shaper and amplifier 117 before being tapped by the said three comparators.

What is claimed is:

1. A table tennis robot apparatus comprising a ball projector, said projector having right and left input ports and right and left output ports; a net means positioned for catching balls hit towards said projector; a chamber having a curved outer wall, entrance and exit ports; ball feed means below said chamber for transferring balls from said net means to said chamber; a motorized fan contained in said chamber; said exit port of said chamber being connected to said input ports of said projector, said fan creating a directional flow of air from said input ports through said output ports of said projector; said projector having right and left adjustable ball servers, said servers being motorized wheels, said wheels being positioned for receiving balls expelled from respective output ports, an adjustable ball deflector vane, said ball deflector vane being positioned between said right and left input ports for biasing balls for movement towards and into contact with either of said right and left wheels; said projector having right and left ball spin means for imparting spin to balls projected from said right and left wheels, said right ball spin means being a pair of side plates and a pair of adjustable guide rails for imparting spin to balls exiting from said right server; and said left ball spin means being a pair of side plates, a bottom guide plate and adjustably connected top and bottom ball deflector plates for imparting spin to balls exiting said left server; a base for supporting said robot on one end of a table opposite a table tennis player; said robot being pivotally supported on said base; motor means for rotating said robot relative to said base in an oscillating fashion; an electrically controlled means for controlling the rotational speed of said right and left wheels and thus controlling the variable speed of balls projected from said robot.

2. A table tennis robot as in claim 1 wherein said net means is comprised of cloth surrounding the sides and end of said one end of said table, said cloth being held above the playing surface of the table by a frame to form a wall and forming a pocket at the bottom thereof through which balls may fall after impacting said wall.

3. A table tennis robot as in claim 2 further comprising a ball feed means, said ball feed means being a pan having a motorized rotatable platter therein, said pan and platter being placed below said net pocket for catching balls falling through said pocket, said pan having a hole in the bottom thereof, said hole being connected to said entrance port of said chamber by a hose member, said platter having one or more well-holes therein such that when said platter is turned a well-hole comes into registry with said hole in said pan and a ball is allowed to drop through said holes, through said hose member and into said entrance port of said chamber.

4. A table tennis robot as in claim 3 wherein said feed means has a rotatable wheel mounted adjacent said pan hole to facilitate guiding balls into said holes as said platter is rotated.

5. A table tennis apparatus as in claim 1 wherein said chamber has a curved ball guide therein, said guide extending from said chamber entrance port to said chamber exit port and placed between said curved wall and said fan, said fan having a cylindrical shape and rotating in a clockwise direction to transfer balls from said entrance port along said curved wall and into said exit port.

6. A table tennis robot as in claim 1 wherein the connection between said projector and said chamber is a tubular T-joint, the vertical section of said "T" having its free end attached to said chamber exit port and the horizontal section of said "T" having each of its ends attached to respective right and left input ports of said projector, said deflector vane being attached to said "T" joint at the intersection of said horizontal and vertical sections.

7. A table tennis robot as in claim 1 wherein said guide rails are hingedly attached to said right server by means of a hinge having a pair of pivoted leaves, said leaves being biased in a downward direction by a spring means and having means for adjustment thereof in an upward spread direction.

8. A table tennis robot as defined in claim 1 wherein said top and bottom deflector plates of said left ball spin means are pivotally attached to said left ball server, means attaching said plates such that they are always parallel to each other and pivot as a unit and further means attached to said plates such that they are biased in a downward direction, and additional means for adjusting said plates at an angle relative to the path of projection of a ball.

* * * * *